United States Patent [19]

Macierewicz

[11] 4,276,059

[45] Jun. 30, 1981

[54] DEAERATOR FOR PULP STOCK

[75] Inventor: Jacek J. Macierewicz, Calgary, Canada

[73] Assignee: Elast-O-Cor Products & Engineering Limited, Canada

[21] Appl. No.: 65,201

[22] Filed: Aug. 9, 1979

[30] Foreign Application Priority Data

May 23, 1979 [CA] Canada ..... 328115

[51] Int. Cl.[3] ..... B01D 19/00

[52] U.S. Cl. ..... 55/52; 55/192; 55/434

[58] Field of Search ..... 55/36, 38, 52, 159, 55/185, 192, 199, 201, 434, 439, 440

[56] References Cited

U.S. PATENT DOCUMENTS

| | | | |
|---|---|---|---|
| 580,169 | 4/1897 | Washington | 55/199 |
| 2,243,176 | 5/1941 | Henst | 55/192 |
| 2,296,543 | 9/1942 | Steen et al. | 55/199 |
| 2,642,950 | 6/1953 | Clark et al. | 55/192 |
| 2,685,937 | 8/1954 | Clark et al. | 55/52 |
| 2,751,031 | 6/1956 | Smith et al. | 55/52 |
| 3,072,224 | 1/1963 | Woody et al. | 55/185 X |
| 3,195,294 | 7/1965 | Verdura et al. | 55/159 |
| 3,488,926 | 1/1970 | Gilman | 55/199 |
| 3,525,196 | 8/1970 | Brieskorn | 55/52 |
| 4,088,457 | 5/1978 | Phillips et al. | 55/199 X |

FOREIGN PATENT DOCUMENTS

| | | | |
|---|---|---|---|
| 501645 | 4/1954 | Canada . | |
| 519243 | 12/1955 | Canada . | |
| 519244 | 12/1955 | Canada . | |
| 528808 | 8/1956 | Canada . | |
| 758880 | 5/1957 | Canada . | |
| 806472 | 2/1969 | Canada . | |
| 806996 | 2/1969 | Canada . | |
| 834709 | 2/1970 | Canada . | |
| 940837 | 1/1974 | Canada . | |
| 931735 | 7/1963 | United Kingdom | 55/159 |
| 589561 | 1/1978 | U.S.S.R. | 55/201 |

*Primary Examiner*—Robert H. Spitzer

*Attorney, Agent, or Firm*—Stevens, Davis, Miller & Mosher

[57] ABSTRACT

A deaerator for removing gases from complex liquids such as pulp slurries in accordance with one aspect of the invention includes an elongated tubular body adapted to be disposed in a generally horizontal position and having an inlet end and an exit end for the flow of liquid therethrough. A chamber adjacent the exit end is provided for accumulating gases therein and a gas removal vent is associated with such chamber. A set of longitudinally extending vertical baffles are disposed in a lower portion of the tubular body, between which baffles a main portion of the liquid flows. A set of lateral baffles extend across the interior of the tubular body, such lateral baffles projecting above the longitudinal baffles and being spaced apart along the tubular body. The lateral baffles are also spaced from the top wall of the tubular body to define therebetween a flow channel along which bubble-containing liquid is guided toward the chamber. The longitudinal baffles serve to create low velocity regions in the liquid adjacent the upper portions of such baffles thus promoting the rise of gas bubbles upwardly. The lateral baffles assist in catching or skimming off the rising bubbles and also direct same into the flow channel.

18 Claims, 6 Drawing Figures

DEAERATOR FOR PULP STOCK

BACKGROUND OF THE INVENTION

This invention relates to the removal of gases from liquids, particularly complex liquids such as pulp slurries.

It is well known in the papermaking industry that the presence of gases in the pulp stock gives rise to a variety of problems; for example the presence of gas bubbles in the papermachine headbox causes foaming of the pulp, a very undesirable condition. The amount of gas in the pulp stock varies from about 3.1% to about 8.8% by volume under normal operating conditions. The gases exist in the pulp stock in three states, namely, as bubbles, as gas in solution, and as gas adsorbed on fibers. The percentages of gases existing in those states are interchangeable depending on the location in the system between the pulp pump and the papermachine headbox. The amount of gases in the bubble state varies from about 37% to about 67% of the total amount of gas. Hydrocyclone stock cleaners supply a large part of the gases to the pulp stock, the air core in the cleaner, with its very low pressure, supplying gases into the accept line with about 85% of these gases being in the bubble state. Part of this gas, downstream of the hydrocyclone cleaners, will change back into the other states, as recited above, if action is not taken to remove such gases. It is therefore of importance to provide suitable means between the hydrocyclone cleaning system and the headbox for removal of these gases while a large portion of same are still in the bubble state.

The prior art has provided a number of devices and processes for removal of gaseous phases from a liquid phase. A first group of these devices is capable of removing gases from what might be termed "clean" liquids, i.e. liquids wherein there is little or no suspended material. The second group of devices is concerned with the removal of gases from complex fluids such as suspensions of cellulose fibers in water, i.e. pulp stock for use in paper manufacture.

One early form of deaerator is shown in U.S. Pat. No. 580,169 dated Apr. 6, 1897 to Washington. This deaerator includes lateral vanes at the top of a tubular member and ridges adjacent the bottom of it that, together with a group of pipes and fingers positioned transverse to the flow direction, obstruct the flow, creating increased turbulence and eddies in the fluid. Gases are collected in a tank at the exit end of the deaerator by means of a system of pipes in communication with a number of different gas collecting points in the apparatus. This deaerator is adapted for use with "clean" liquids only; the numerous dead "pockets" in the various flow obstructing devices render it unsuitable for use with pulp slurries as the fibers would immediately accumulate on or in the various obstructions thus causing the apparatus to eventually plug and become inoperative.

Another device for removing gases from liquids is shown in U.S. Pat. No. 3,525,196 issued Aug. 25, 1970 to Brieskorn. This system is described as being useful for extracting gases from the cooling system of an internal combustion engine. The apparatus includes a tubular housing having inlet and outlet openings of about the same diameter as the flow lines connected thereto and surrounded by a housing of larger diameter. The inner housing is provided with an opening in the region of the upper flow path upstream and another opening near the lower flow path downstream. Vent gases are exhausted by an upper opening of the larger diameter housing which is connected with an expansion chamber provided with a pressure relief valve. The liquid flow is moved through the inner housing along the openings thereby allowing air or gas to escape by the upstream opening and discharged fluid to re-enter by the downstream opening of the inner housing. Again, as with the Washington patent, the apparatus is useful for generally "clean" liquids but not for complex liquids such as pulp slurries. Furthermore, the fluid velocities through the device must be kept relatively slow as compared with those velocities which are commonly used in conjunction with pulp slurries.

Another group of devices works on the principle of passing a very slowly flowing bi-phase mixture through a big tank and exposing its thin layer fluid surface to allow escape of gases therefrom. The gaseous phase is caused to pass through a series of baffles which provide sufficient surface area to allow for separation and collecting of liquid droplets from the gaseous phase. Tanks or vessels are generally not pressurized and empty themselves by means of fluid head energy.

A still further group of deaerating devices, related to paper pulp stock cleaning, involve means for atomizing the stock by spraying while applying a high vacuum thereto. High deaerating efficiencies are achieved but these types of installations tend to be relatively complex and expensive.

SUMMARY OF THE INVENTION

It is one object of the invention to provide a relatively compact, simple and thus inexpensive deaerator for removing air and other gases from pulp slurries and the like.

It is a further object of the invention to provide a deaerator which is capable of utilizing only the fluid energy, i.e. its pressure and velocity energy, to operate the deaerator thus avoiding additional costs associated with energy expenditures.

A still further object is to provide an improved deaerator which is capable of operation with only a minimal pressure drop thereacross thus keeping energy expenditures to a minimum.

A still further object is to provide a deaerator having a baffle arrangement such as to provide low velocity regions in the fluid to enhance removal of gas bubbles into a collection and discharge system while at the same time affording minimal disruption to a main flow of the pulp slurry through the device.

A deaerator for removing gases from complex liquids such as pulp slurries in accordance with one aspect of the invention includes an elongated tubular body adapted to be disposed in a generally horizontal position and having an inlet end and an exit end for the flow of liquid therethrough. A chamber adjacent the exit end is provided for accumulating gases therein and a gas removal vent is associated with such chamber. A set of longitudinally extending vertical baffles are disposed in a lower portion of the tubular body, between which baffles a main portion of the liquid flows. A set of lateral baffles extend across the interior of the tubular body, such lateral baffles projecting above the longitudinal baffles and being spaced apart along the tubular body. The lateral baffles are also spaced from the top wall of the tubular body to define therebetween a flow channel along which bubble-containing liquid is guided toward the chamber. The longitudinal baffles serve to create low velocity regions in the liquid adjacent the upper portions of such baffles thus promoting the rise of gas bubbles upwardly. The lateral baffles assist in catching or skimming off the rising bubbles and also direct same into the flow channel.

In a further feature of the invention the top wall of the tubular body is inclined upwardly from the inlet end to the gas accumulating chamber. As a still further feature the lateral baffles are inclined generally in the direction of the flow along of liquid.

The longitudinal baffles preferably have sloping end portions adjacent the inlet end to prevent or reduce any tendency of the fibrous material to lodge or hang up on same.

In a preferred form of the invention the length of the tubular body from the inlet end to the furthest lateral baffle is at least about seven times the vertical dimension of the fluid flow path defined at the inlet end. This ensures that the smallest bubbles likely to be encountered in operation have sufficient time to rise upwardly and to be caught by the lateral baffles prior to the time the liquid passes beyond the chamber.

The deaerator design, in the preferred embodiment, is such that the maximum flow velocity longitudinally of the body is not greater than about three meters per second. This helps to ensure that the gas bubbles remain as such, i.e. as "elongated bubbles" or "stratified" flows of gases as will be hereinafter described. The overall cross-sectional area of the tubular body, by virtue of the upwardly inclined top wall of same, also increases from the inlet end to the gas accumulating chamber; this serves to effect a gradual deceleration of the liquid flow moving through the deaerator thus assisting in promoting bubble collection.

In the preferred form of the invention the longitudinal baffles are flat, continuous plate-like elements disposed in parallel relation to one another with the lateral baffles also being plate-like elements and the heights of same gradually increasing from the inlet end to the above-mentioned chamber.

A method of removing gases from liquids such as pulp slurries in accordance with a further aspect of the invention includes flowing the liquid through an elongated tubular body as described above from its inlet end to and through its exit end and accumulating gases escaping from the liquid in the gas accumulating chamber which is disposed adjacent the exit end and venting the gases which accumulate therein. The improvement according to the invention includes passing a main portion of the liquid flow along and between the longitudinally extending vertically arranged baffles in the lower portion of the tubular body with such longitudinal baffles creating low velocity regions in the liquid adjacent the upper portions of the longitudinal baffles thus promoting the rise of gas bubbles in the upward direction, and catching and skimming off the upwardly rising bubbles by way of the transversally disposed baffles, as described above, and directing the bubbles into the flow channel which is defined between the lateral baffles and the top wall of the tubular body. The bubbles move along such flow channel and into the gas accumulating chamber. In the preferred form of the invention, the flow channel along which the bubbles move is upwardly inclined toward the gas accumulating chamber. In a preferred form of the invention, the maximum flow velocity longitudinally of the tubular body is not greater than about three meters per second thus helping to ensure that the gas flow pattern is in the "stratified" or "elongated bubble" form thereby to allow for its removal by the baffle arrangements and the associated equipment as described above.

BRIEF DESCRIPTION OF THE DRAWINGS

In drawings which illustrate an embodiment of the invention.

DESCRIPTION OF THE PREFERRED EMBODIMENT

Figure 1:
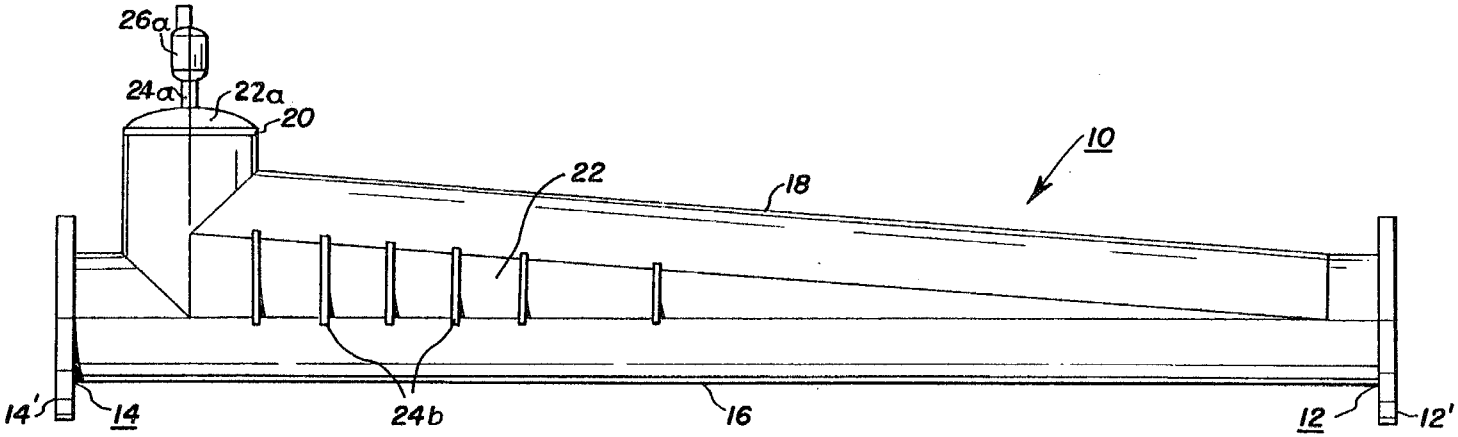
FIG. 1 is a side elevation view of the deaerator illustrating the diverging tubular body, the collecting chamber and its vent arrangement.

With reference now to the drawings, FIG. 1 illustrates the deaerator and shows an elongated tubular body 10 disposed in a generally horizontal position and having an inlet end 12 and an exit end 14. The inlet and exit ends are provided with suitable flange connectors 12' and 14' respectively thereby to enable the deaerator to be connected in the pulp slurry line leading from a bank of hydrocyclone cleaners (not shown) to a paper-machine headbox (not shown). The tubular body 10 includes a bottom wall 16 comprising a half-round pipe section, such bottom wall 16 being disposed in a horizontal position in the normal operating position of the apparatus. Tubular body 10 also includes a top wall 18 which is inclined upwardly from a point adjacent the inlet end 12 to an accumulating chamber 20. The top wall 18 also comprises a half-round pipe section of the same diameter as that used for bottom wall 16. Triangular side wall sections 22 are interposed between the bottom and top wall portions 16 and 18 and welded thereto in suitable fashion with spaced apart vertical stiffening ribs **24*b* being provided externally of the side wall portions 22. The chamber 20 for accumulating gases is shown as being in the form of a right-circular cylinder with its axis being vertically disposed and having the same outside diameter as the exit end portion 14 of the tubular body 10. The chamber 20 is provided with a dished head 22*a*, in a central portion of which is provided a vent opening 24*a*, the latter being in communication with an automatic air vent valve 26*a* of any suitable commercially available variety which serves to vent the interior of chamber 20** to atmosphere under the influence of the static pressure head existing in the pulp slurry accept line (usually in the order of 5 lbs. per sq. inch or slightly more). One suitable commercially available variety of air vent is that made by Armstrong Machine Works of Three Rivers, Mich., U.S.A., as Model No. 11-AV.

Figure 2:
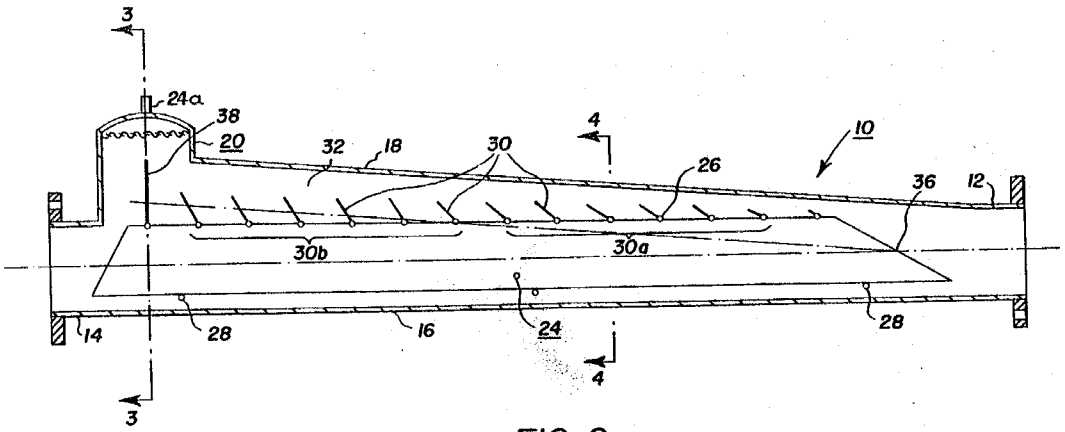
FIG. 2 is an axial vertical section view of the deaerator showing the interior of the tubular body with its longitudinal and lateral baffles.
Figure 3:
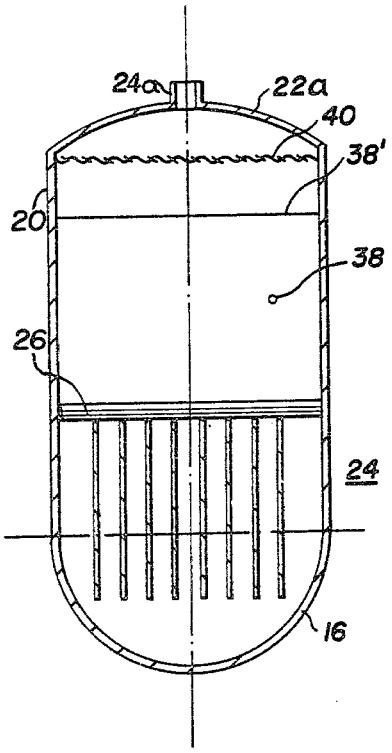
FIG. 3 is a cross-section view of the deaerator taken through the collecting chamber, i.e. along line 3—3 of FIG. 2.
Figure 4:
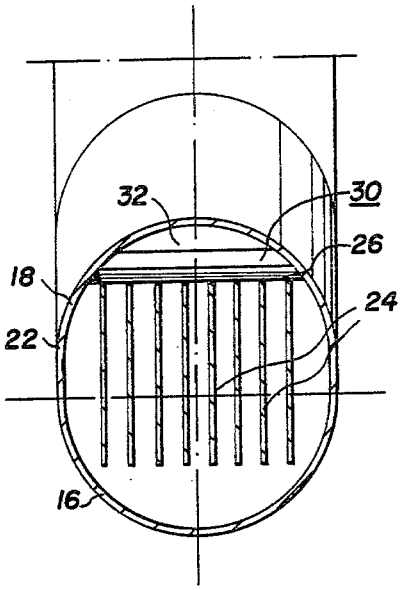
FIG. 4 is a typical cross-section view of the deaerator showing the baffle arrangements and taken along line 4—4 of FIG. 2.

With particular reference to FIGS. 2–4 it will be seen that the lower portion of the tubular body contains a plurality of longitudinally extending baffles 24. The longitudinal baffles 24 extend from a point closely adjacent the inlet end 12 to a point closely adjacent the exit end 14. The longitudinal baffles 24 are suspended from a series of spaced apart tubular support members 26, the opposing ends of the latter being welded to the interior walls of the tubular body 10. As best seen in FIGS. 3 and 4, the longitudinal baffles 24 each comprise an elongated flat plate-like element connected at spaced apart points along its upper edge to the above-mentioned spaced support members 26 and securely welded thereto. The longitudinal baffles 24 are all vertically disposed in substantially equally spaced apart relation transversally of the longitudinal axis of the tubular body 10. The spacing between longitudinal baffles 24 is not particularly critical; however, for purposes of illustration, in a deaerator having a diameter at inlet end 12 of 32 inches, the center-to-center spacing of baffles 24 was 2.4 inches, each baffle being one-eighth inch thick steel plate. In order to assist in maintaining longitudinal baffles 24 in the desired parallel spaced apart relationship, a plurality of transversally extending lower edge support elements 28 are also provided, their opposing ends being welded to the bottom wall member 16, such support elements being illustrated in FIG. 2.

The interior of tubular body 10 also contains a series of lateral baffles 30, each lateral baffle 30 being connected to and extending upwardly from an associated support member 26. The lateral baffles 30 are all inclined generally in the direction of fluid flow from the inlet through to the exit with a first group of such lateral baffles **30*a* located most closely adjacent the inlet end 12 being inclined to the horizontal by about a 45° angle with the remaining group of baffles 30*b* as shown in FIG. 2 being preferably inclined by about a 60° angle to the horizontal. These angles are by no means critical and may be varied considerably. Further, the baffles 30 may all be inclined by the same amount; however, the dual-angle arrangement described above affords the best flow pattern for maximum separation efficiency in the particular embodiment described. The lateral baffles 30 are all spaced from the top wall 18 of the tubular body to define therebetween a flow channel 32 along which bubble-containing liquid is guided toward the chamber 20 in a manner to be described hereinafter. It will be noted that this flow channel 32, as defined above, gradually increases in cross-sectional area from adjacent the inlet end 12 to the gas accumulating chamber 20. It will also be noted that the lateral baffles have width dimensions which increase from adjacent the inlet end toward the chamber 20; in other words, the heights of the upper edges of the lateral baffles 30 gradually increase toward the chamber 20. This variation in the width dimension of the lateral baffles 30 is done so as to ensure that the flow channel 32** is of adequate cross-sectional area at all points throughout its length while also providing for the gradual area increase noted above.

In order to prevent hang-up of pulp fibers, the inlet ends 36 of the longitudinal baffles 24 are sloped at a moderately shallow angle, e.g. about 30° to the horizontal. In general, sharp rough edges and any rough or jagged metal portions should be ground off reasonably smoothly to reduce the possibility of hang-ups of fibers occurring.

With reference again to FIGS. 2 and 3, it will be seen that the chamber 20 includes a vertically disposed partition member or weir 38 extending upwardly therein from a final support member 26. The upper edge 38' of weir 38 is spaced from the top 22 of chamber 20 and the purpose of the weir 38 is to bring the flow velocity in the chamber 20 down almost to 0 thus affording sufficient time for the gas bubbles to rise to the liquid surface and to burst thus releasing the air and other gases therefrom. It is preferred that the upper portion of chamber 20 be provided with a screen 40 of expanded metal or the like which extends completely across the upper end of the chamber in spaced relation to the upper edge 38' of weir 38. The purpose of this screen 40 is to reduce somewhat carry-over of liquid droplets into the vent **24*a*** during operation.

It was noted previously that gases exist in the stock in three states, namely, as bubbles, as gas in solution, and as gas adsorbed on the fibers. The amount of gases in the stock varies from 3.1 to about 8.8% by volume under normal operating conditions. As noted previously, the percentages of gases existing in the above three states are interchangeable depending on the location of the stock between the pump and the headbox. The amount of gases in the bubble state normally varies from about 37 to about 67% of the total gas amount. However, the air core in the hydrocyclone cleaner, with its relatively low pressure, introduces gases into the accept flow with about 85% of such gases being in the bubble state. Part of these gases will change into the other states as noted above if not removed and in view of this the deaerator should be positioned as closely as possible to the hydrocyclone cleaners while the major portion of the gases are still in the bubble state, it being kept in mind that the deaerator should be able to remove up to 80% of the total amount of gas, namely, up to about 7% of the flow volume.

Those skilled in the art may wish to refer to a text entitled "The Flow of Complex Mixtures In Pipes" by G. W. Govier and K. Aziz, Van Nostrand Reinhold Co. 1977. This text, beginning at page 4 gives a description of terminal settling velocities of certain particles including fluid and gas particles. Beginning at page 65 of this same text the rise velocity of single bubbles in liquids is discussed in detail while pages 504 to 523 are particularly concerned with the horizontal flow of gas-liquid mixtures and include various graphs and tables describing flow pattern details for various air-water mixtures flowing in horizontal pipes. Reference may also be had to a paper entitled "Gas in Papermaking Stock" by J. D. Broadway appearing in the "Pulp and Paper Magazine of Canada", Convention Issue, 1956, beginning at page 185, as well as a paper entitled "The Removal of Dirt and Gases From Pulp Stock Suspensions" by Horace Freeman and John D. Broadway, TAPPI, Volume 36, No. 5, May 1953 beginning on page 236.

Having regard to the literature cited above, it has been determined that the pulp slurry, leaving the hydrocyclone cleaning system with most of the gases in the bubble form, should be made to flow with relatively low velocities ensuring the "elongated bubble" or "stratified" flows. Relatively high flow velocities would produce "dispersed bubble" or "slug" gaseous flows and these would not be efficiently separated from the liquid by the apparatus described herein. The flow velocity thus should be kept below about 3 meters per second and preferably below about 2.6 meters per second, regardless of the diameter of the flow channel, in the range of gaseous phase contents likely to be encountered in operation. With the flow velocities not exceeding the velocities given above, the desired "elongated bubble" or "stratified" flow pattern can be achieved.

The great majority of the bubbles carried by the liquid are likely to be at least 3 millimeters in diameter and most likely over 5 millimeters and to have an elongated shape. It is furthermore known that these elongated gas bubbles tend to flow in the top portion of a pipe or conduit. In curved pipes the bubbles tend to move toward the inner curved wall of the conduit. There will also be some smaller bubbles at different levels of the horizontal conduit that will try to move up after being discharged from the hydrocyclone cleaners. These flow characteristics of the bubbles are taken advantage of in the present design in order to ensure that most of the bubbles move toward the top wall 18 of the apparatus and thence move therealong into the accumulating chamber. The smallest bubbles likely to be encountered in any amount will have a diameter of about 0.75 millimeters. The deaerator should have a length at least sufficient as to allow for bubbles of this size to move upwardly from the bottom of the tubular body adjacent its inlet end to a point where they can be picked up by the last one of the lateral baffles 30 and forwarded or directed into the accumulating chamber 20. In calculating the rising velocity of this smallest bubble of 0.75 millimeters, Stokes law may be used which gives, for a bubble of the above size, and with water viscosity taken at 30° C., a rise velocity of 0.38 meters per second or about 1.26 feet per second. This figure inherently includes a substantial safety margin because virtually all of the bubbles will be greater than 0.75 millimeters and the larger the bubble the faster it moves upwardly. Furthermore, the usual temperature of a pulp slurry is above 100° F. or 38° C. and the higher the temperature the lower the viscosity and hence the higher the terminal rising velocity of the bubble. It should also be kept in mind that the type of movement of the bubble in relation to the fluid is a laminar flow although the fluid itself is in high Reynolds number turbulent motion.

Figure 5:
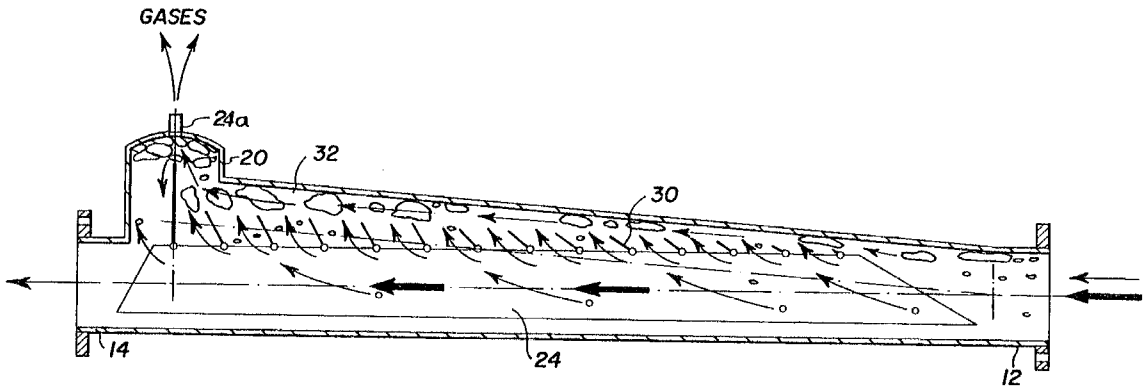
FIG. 5 is a further axial vertical section view as in FIG. 2 diagrammatically illustrating the main fluid flow and bubble flow directions.

It will be clear from an inspection of FIG. 5, for example, that the length of the tubular body 10 from the inlet end 12 to the last one of the lateral baffles 30, i.e. that lateral baffle 30 which is furthest from the inlet end, should be in the same proportion to the vertical dimension of the inlet 12 (the inlet diameter) as the fluid velocity of the main flow between longitudinal baffles 24 is to the terminal rising velocity of the bubble. For a horizontal fluid velocity between the longitudinal baffles of 2.6 meters per second, and a bubble rise velocity of 0.38 meters per second, it can be determined that the above-noted length should be at least about 7 times the inlet diameter. If the horizontal fluid velocity between the longitudinal baffles is at the maximum rate of about three meters per second, then the above-noted distance should be about 8 times the inlet diameter. In order to provide an ample margin of safety, the designer will probably wish to make the distance from the inlet end to the last lateral baffle about 10 times the inlet diameter.

Figure 6:
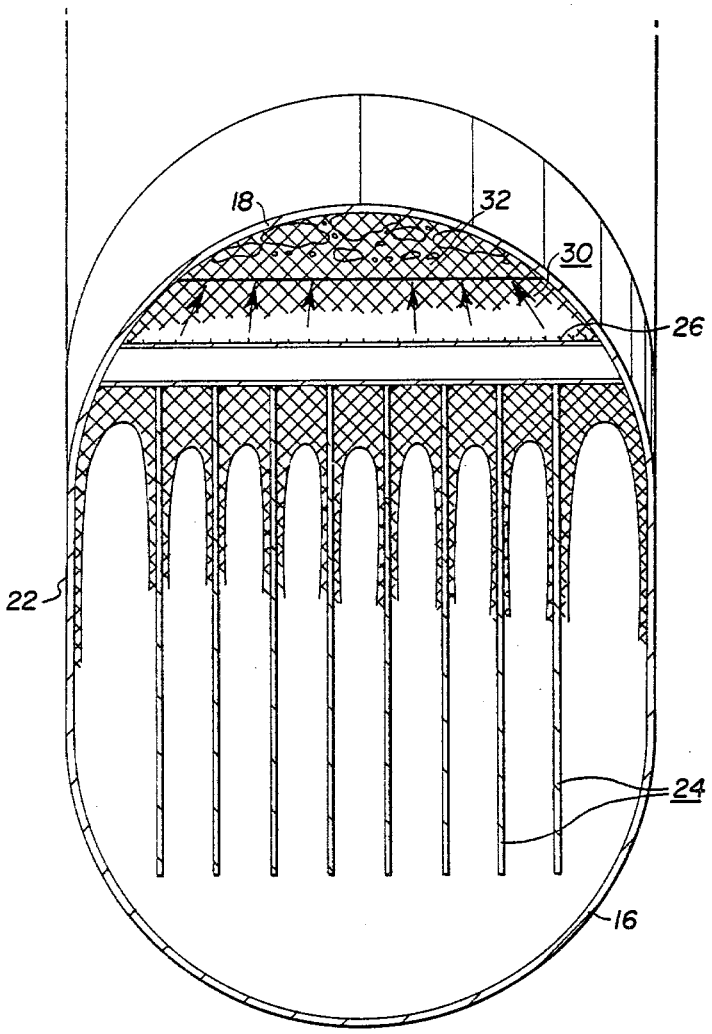
FIG. 6 is a view similar to that of FIG. 3 on an enlarged scale diagrammatically illustrating the low velocity regions as created by the baffle arrangements.

The operation of the deaerator is best illustrated in FIGS. 5 and 6. The pulp slurry, leaving the hydrocyclone cleaning system with most of the gases in the bubble form, as noted above, flows with velocities ensuring the "elongated bubble" or "stratified" flow pattern. After entering the tubular body 10 of the deaerator, the major portion of the flow enters between the longitudinal baffles 24 which decrease the turbulance of the flow and create low velocity regions particularly adjacent the upper portions of such baffles 24 as illustrated by the shaded portions in FIG. 6. These low velocity regions assist in the upward movement of the bubbles. The lateral baffles 30 act to skim the bubbles off the main flow and to guide them smoothly into the flow channel 32 defined immediately above baffles 30. A slowly moving liquid stream passing along flow channel 32 carries these gas bubbles into the accumulating chamber 20. In the chamber 20, by virtue of its relatively large cross-sectional area and by virtue of the presence of the weir 38, the flow velocity becomes very low thus affording a good opportunity for the gases to escape from the fluid and to collect at the top of chamber 20 with such gases being vented to atmosphere through the above-mentioned pressure operated vent valve 26*a*. In the meantime, the main flow of pulp slurry, with its gases removed, flows without major disruptions along the interior of tubular chamber 10, passing below the accumulating chamber 20 and exiting via exit end 14.

What is claimed is:

1. A deaerator for removing gases from complex liquids such as pulp slurries comprising an elongated tubular body adapted to be disposed in a generally horizontal position and having an inlet end and an exit end for the flow of liquid therethrough, a chamber adjacent the exit end for accumulating gases therein and a gas removal vent associated with said chamber, a set of longitudinally extending laterally spaced apart baffles in a lower portion of said tubular body disposed generally vertically and between which a main portion of the liquid flows, a set of lateral baffles extending across the interior of the tubular body and projecting above the longitudinal baffles and spaced apart along said tubular body such that the spaces between the longitudinal baffles communicate directly with the spaces between the lateral baffles, the lateral baffles being spaced from a top wall of the tubular body to define therebetween a flow channel along which bubble-containing liquid is guided toward the chamber, the longitudinal baffles creating low velocity regions in the liquid adjacent the upper portions of the longitudinal baffles which promote the rise of gas bubbles upwardly, the lateral baffles being adapted to catch and skim off the rising bubbles and to direct same therebetween into said flow channel.

2. The deaerator of claim 1 wherein said top wall of the tubular body is inclined upwardly from said inlet end to said chamber to promote the movement of the bubbles along the flow channel defined between the top wall of the tubular body and the lateral baffles.

3. The deaerator of claim 2 wherein the lateral baffles are inclined in the direction of the flow through said body.

4. The deaerator of claim 1, 2 or 3 wherein said longitudinal baffles have sloping end portions adjacent said inlet end to prevent hang up of fibrous material thereon.

5. The deaerator of claim 1, 2 or 3 wherein the length of the tubular body from the inlet end to that lateral baffle furthest from the inlet end is at least about 7 times the vertical dimension of the fluid flow path defined at the inlet end.

6. The deaerator of claim 1, 2 or 3 wherein the cross sectional size of the tubular body is such that the maximum flow velocity longitudinally of such body is not greater than about 3 meters/second.

7. The deaerator of claim 1, 2 or 3 wherein said longitudinal baffles are generally flat, continuous plate-like elements in parallel relation to one another and which extend from adjacent the inlet end toward said exit end and below said chamber.

8. The deaerator of claim 1, 2 or 3 wherein said longitudinal baffles are flat, continuous plate-like elements in parallel relation to one another and said lateral baffles also being plate-like elements, the heights of which gradually increase from the inlet end to said chamber.

9. The deaerator of claim 1, 2 or 3 wherein the flow channel defined between the top wall of the tubular body and the lateral baffles gradually increases in cross-sectional size from said inlet end to said chamber.

10. A deaerator for pulp slurries and the like comprising:

(a) an elongated tubular body adapted to be disposed in a generally horizontal operating position and through which body liquids to be deaerated are adapted to flow from an inlet end to and through an exit end thereof;

(b) a chamber disposed adjacent the exit end and providing a region for collection of gases, (c) vent means on the chamber for releasing gases therefrom;

(d) a plurality of baffles disposed in a lower region of said tubular body and extending longitudinally of same from the region of the inlet end toward said exit end and below said chamber in spaced, generally parallel relation to one another and between which a major portion of the liquid flows, such longitudinal baffles being arranged so that they are vertically disposed when the tubular body is in the horizontal operating position; the longitudinal baffles defining low velocity regions adjacent upper portions thereof which promote the rise of gas bubbles toward a top portion of the tubular body;

(e) a plurality of lateral baffles extending transversally of said tubular body closely adjacent the upper portions of the longitudinal baffles, the lateral baffles being spaced from the top of the tubular body to define therebetween a flow channel along which bubble containing liquid is guided toward the chamber, said lateral baffles being in spaced apart relation along the longitudinal baffles with the spaces between the longitudinal baffles being in direct fluid communication with the spaces between the lateral baffles and said lateral baffles being arranged to catch or skim off bubbles rising between the longitudinal baffles and to direct same into and along the flow channel, said lateral baffles further serving to slow the flow of liquid in the flow channel, with said gas collecting in the region provided by said chamber and being vented therefrom via said vent means.

11. The deaerator of claim 10 wherein said lateral baffles are sloped in the direction of the flow through said tubular body.

12. The deaerator of claim 11 wherein the tubular body includes a top portion which is inclined upwardly from said inlet end to said chamber to promote movement of the bubbles toward and along the top portion and into said chamber.

13. The deaerator of claim 12 wherein the cross-sectional area of the tubular body increases from the inlet end to said chamber.

14. The deaerator of claim 10, 11 or 12 wherein the length of the tubular body from the inlet end to that lateral baffle furthest from the inlet end is at least about 7 times the vertical dimension of the fluid flow path at the inlet end.

15. A method of removing gases from liquids such as pulp slurries including: flowing the liquid through an elongated tubular body disposed in a generally horizontal position from an inlet end to and through an exit end thereof, accumulating gases escaping from the liquid in a chamber adjacent the exit end and venting the gases which accumulate therein, the improvement comprising passing a main portion of the liquid flow along and between a set of spaced apart longitudinally extending vertically arranged baffles in a lower portion of said tubular body, the longitudinal baffles creating low velocity regions in the liquid adjacent the upper portions of the longitudinal baffles which promotes the rise of gas bubbles upwardly, there being a set of lateral baffles extending across the interior of the tubular body and projecting above the longitudinal baffles and spaced apart along said tubular body with the spaces between the longitudinal baffles being in direct fluid communication with the spaces between the lateral baffles, the lateral baffles being spaced from a top wall of the tubular body to define therebetween a flow channel, and catching and skimming off the bubble containing flow rising upwardly in the spaces between the longitudinal baffles by way of the lateral baffles and passing same directly by way of the spaces between the lateral baffles into said flow channel for movement therealong toward the gas accumulating chamber.

16. The method of claim 15 wherein said movement of the bubbles along the flow channel is along a generally upwardly inclined path to the gas accumulating chamber.

17. The method of claim 16 wherein the lateral baffles direct the bubble-containing liquid in paths which are inclined in the direction of the flow along the flow channel.

18. The method of claim 15, 16 or 17 wherein the maximum flow velocity longitudinally of such tubular body is not greater than about 3 meters/second.

* * * * *